US010472761B2

(12) United States Patent
Pistochini et al.

(10) Patent No.: US 10,472,761 B2
(45) Date of Patent: Nov. 12, 2019

(54) SELF-CALIBRATING AUTOMATIC CONTROLLER TO DETERMINE END OF CYCLE AND TRACK DRYER CYCLE EFFICIENCY

(71) Applicant: THE REGENTS OF THE UNIVERSITY OF CALIFORNIA, Oakland, CA (US)

(72) Inventors: Theresa Pistochini, Davis, CA (US); Caton Mande, Davis, CA (US); Mark Modera, Piedmont, CA (US)

(73) Assignee: THE REGENTS OF THE UNIVERSITY OF CALIFORNIA, Oakland, CA (US)

( * ) Notice: Subject to any disclaimer, the term of this patent is extended or adjusted under 35 U.S.C. 154(b) by 139 days.

(21) Appl. No.: 15/857,740

(22) Filed: Dec. 29, 2017

(65) Prior Publication Data

US 2018/0195229 A1 Jul. 12, 2018

Related U.S. Application Data

(63) Continuation of application No. PCT/US2016/040557, filed on Jun. 30, 2016.
(Continued)

(51) Int. Cl.
*D06F 58/28* (2006.01)
*D06F 58/02* (2006.01)

(52) U.S. Cl.
CPC ..... *D06F 58/28* (2013.01); *D06F 58/02* (2013.01); *D06F 2058/289* (2013.01);
(Continued)

(58) Field of Classification Search
CPC .. D06F 58/28; D06F 58/02; D06F 2058/2829; D06F 2058/2861;
(Continued)

(56) References Cited

U.S. PATENT DOCUMENTS 4,231,166 A * 11/1980 McMillan ..... D06F 58/28 219/400
5,172,490 A 12/1992 Tatsumi
(Continued)

FOREIGN PATENT DOCUMENTS

CA 2887462 A1 * 10/2015 ..... D06F 58/28
CN 101831781 A 9/2010
(Continued)

OTHER PUBLICATIONS

ISA/US, United States Patent and Trademark Office, International Search Report and Written Opinion dated Oct. 7, 2016, related PCT international application No. PCT/US2016/040557, pp. 1-9, with claims searched, pp. 10-14.

*Primary Examiner* — Stephen M Gravini
(74) *Attorney, Agent, or Firm* — O'Banion & Ritchey LLP; John P. O'Banion

(57) ABSTRACT

An apparatus and method for controlling the drying cycle in a clothes dryer. The dryer controller measures differences between air inlet temperature and temperature of an air outlet, drum, and/or drum contents, from which it first estimates water weight of original drum contents based on changes in this temperature differential over a first period of time. A first dryness threshold is later reached when the amount of remaining water estimated by the temperature difference profiling reaches a threshold. A cooling cycle is then performed, followed by an estimation of remaining drying cycle time from estimating remaining water based on temperature differentials. The heater is then switched back on for the remaining time, after which a cooling cycle is preferably performed before ending the dryer cycle.

20 Claims, 4 Drawing Sheets

FIG. 2A

FIG. 3

Related U.S. Application Data

Figure 1:
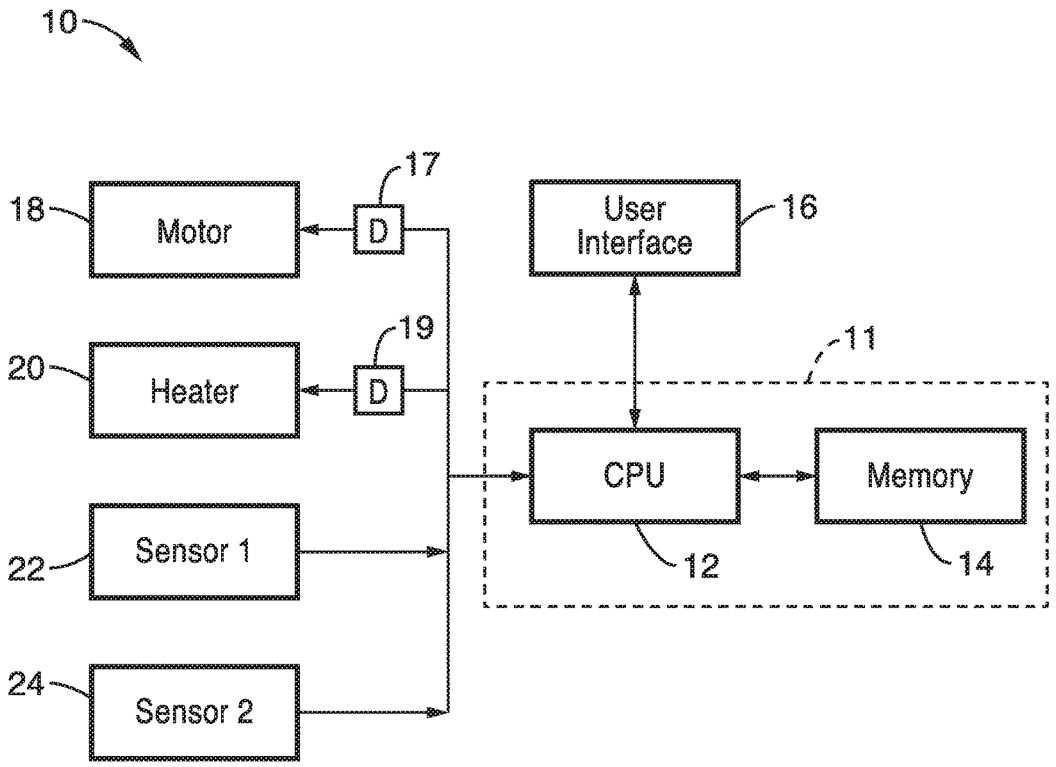

(60) Provisional application No. 62/187,927, filed on Jul. 2, 2015.

(52) U.S. Cl.
CPC ..... *D06F 2058/2829* (2013.01); *D06F 2058/2861* (2013.01); *D06F 2058/2893* (2013.01); *D06F 2058/2896* (2013.01)

(58) Field of Classification Search
CPC ..... D06F 2058/289; D06F 2058/2893; D06F 2058/2896
USPC ..... 34/524, 595–610, 549
See application file for complete search history.

(56) References Cited

U.S. PATENT DOCUMENTS

| | | | | |
|---|---|---|---|---|
| 5,899,005 | A * | 5/1999 | Chen | D06F 58/02 34/528 |
| 6,098,310 | A * | 8/2000 | Chen | D06F 58/02 34/475 |
| 6,122,840 | A | 9/2000 | Chbat et al. | |
| 7,017,280 | B2 | 3/2006 | Green | |
| 7,900,374 | B2 * | 3/2011 | Bae | D06F 25/00 204/431 |
| 7,975,401 | B2 * | 7/2011 | Beaulac | D06F 58/28 34/549 |
| 8,286,369 | B2 * | 10/2012 | Dittmer | D06F 58/28 204/560 |
| 8,549,770 | B2 * | 10/2013 | Bellinger | D06F 58/28 34/486 |
| 8,661,706 | B2 * | 3/2014 | Bellinger | D06F 58/28 34/486 |
| 9,657,433 | B2 * | 5/2017 | Doh | D06F 58/28 |
| 10,087,570 | B2 * | 10/2018 | Santillan Galvan | D06F 58/28 |
| 10,184,208 | B2 * | 1/2019 | Rizzi | D06F 58/28 |
| 2018/0195229 | A1 * | 7/2018 | Pistochini | D06F 58/28 |

FOREIGN PATENT DOCUMENTS

| | | | | |
|---|---|---|---|---|
| DE | 102010036938 | A1 * | 6/2011 | D06F 58/28 |
| EP | 2977503 | B1 * | 4/2019 | D06F 58/28 |
| WO | 2014124490 | A1 | 8/2014 | |
| WO | WO-2016012228 | A1 * | 1/2016 | D06F 58/28 |
| WO | WO-2017004450 | A1 * | 1/2017 | D06F 58/28 |

* cited by examiner

SELF-CALIBRATING AUTOMATIC CONTROLLER TO DETERMINE END OF CYCLE AND TRACK DRYER CYCLE EFFICIENCY

CROSS-REFERENCE TO RELATED APPLICATIONS

This application is a 35 U.S.C. § 111(a) continuation of PCT international application number PCT/US2016/040557 filed on Jun. 30, 2016, incorporated herein by reference in its entirety, which claims priority to, and the benefit of, U.S. provisional patent application Ser. No. 62/187,927 filed on Jul. 2, 2015, incorporated herein by reference in its entirety. Priority is claimed to each of the foregoing applications.

The above-referenced PCT international application was published as PCT International Publication No. WO 2017/004450 on Jan. 5, 2017, which publication is incorporated herein by reference in its entirety.

STATEMENT REGARDING FEDERALLY SPONSORED RESEARCH OR DEVELOPMENT

Not Applicable

INCORPORATION-BY-REFERENCE OF COMPUTER PROGRAM APPENDIX

Not Applicable

NOTICE OF MATERIAL SUBJECT TO COPYRIGHT PROTECTION

A portion of the material in this patent document is subject to copyright protection under the copyright laws of the United States and of other countries. The owner of the copyright rights has no objection to the facsimile reproduction by anyone of the patent document or the patent disclosure, as it appears in the United States Patent and Trademark Office publicly available file or records, but otherwise reserves all copyright rights whatsoever. The copyright owner does not hereby waive any of its rights to have this patent document maintained in secrecy, including without limitation its rights pursuant to 37 C.F.R. § 1.14.

BACKGROUND

1. Technical Field

The technology of this disclosure pertains generally to clothes dryer appliances, and more particularly to a controller for determining end of cycle in a clothes dryer.

2. Background Discussion

Existing clothes dryers primarily utilize one of two methods for using sensing technology to determine drying cycle endpoint. The first method is the use of a single temperature sensor on the exhaust outlet. There are two significant short-comings with this method. (1) The exhaust temperature is impacted by air inlet temperature which may vary widely for dryers located in unconditioned spaces (such as a garage). (2) The second drawback is that the accuracy of the temperature sensor drifts with time. A second common method of sensing the end of a drying cycle is using a moisture sensor located inside the dryer drum. This sensor has two metal contacts that are shorted when wet clothes pass over. The short-coming of this technology is that the contacts can fail because they must be in contact with the dryer contents and can be easily damaged. Even when the sensor is working properly it only senses the wetness of the clothing that passes over it and not the entire dryer contents.

Accordingly, a need exists for a method and apparatus for controlling the operation of a clothes dryer to accurately sense the endpoint of the drying cycle. The present disclosure provides for accurate endpoint sensing while providing additional benefits.

BRIEF SUMMARY

An automatic control for clothes dryers that provides accurate estimates for the drying cycle for turning off the heating cycle of the dryer when the clothes have reached the desired low level of moisture content, referred to herein as a "dryness level". In at least one embodiment, the controller monitors the changing temperature of the dryer exhaust air compared to the incoming air to determine when a sufficient level of moisture has been removed from the clothes. The controller of the present disclosure applies to both gas and electric dryers, to both vented and ventless (condensation) dryers, and to dryers utilized in a variety of textile drying applications (e.g., household, commercial, and other environments).

In at least one embodiment, the controller is configured with an on-site calibration function, and alternatively or additionally, for performing periodic self-calibration to increase long-term accuracy and functionality. In some embodiments, sufficient accuracy is provided without the use of the self-calibration step because relative changes in temperature over the course of the cycle are being tracked, so that sensor drift has minimal effect on the dryer control cycles.

In at least one embodiment, the dryer shut-off function is performed in response to monitoring the changing temperature of the dryer exhaust air, drum temperature, or drum contents temperature, compared to the incoming air temperature to determine when the load is nearly dry and the remaining water weight is below a desired threshold. The changing temperature of the dryer exhaust air, drum temperature, or drum contents temperature, compared to the incoming air is used to determine the initial weight of the clothes and the weight of the clothes at a later time in the cycle (the weight is reduced as water evaporates). The current weight along with the remaining water weight is used to determine the remaining drying time to dry the load to the desired percent remaining moisture content.

At least one embodiment is configured with an energy efficiency reporting function. This difference of the initial weight and the final weight is used to determine the amount of water removed over the course of the cycle. This information, combined with the cycle run-time, is used to calculate the energy efficiency of the drying process. This efficiency is tracked over time and can alert the user to when the actual efficiency falls out of the expected range.

Further aspects of the technology described herein will be brought out in the following portions of the specification, wherein the detailed description is for the purpose of fully disclosing preferred embodiments of the technology without placing limitations thereon.

BRIEF DESCRIPTION OF THE SEVERAL VIEWS OF THE DRAWING(S)

The technology described herein will be more fully understood by reference to the following drawings which are for illustrative purposes only:

FIG. 1 is a block diagram of a clothes dryer configured according to an embodiment of the present disclosure.

Figure 2A:
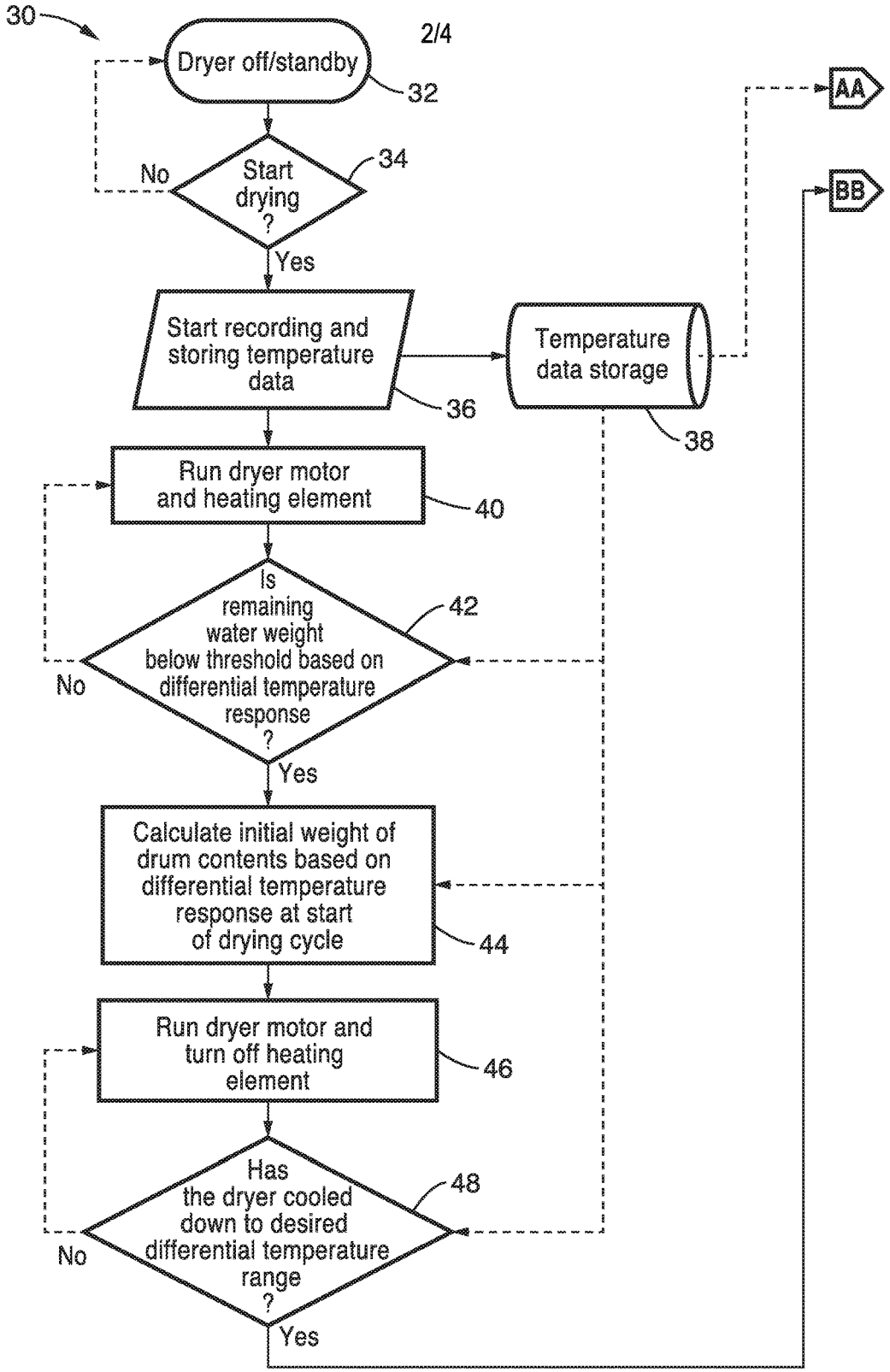
Figure 2B:
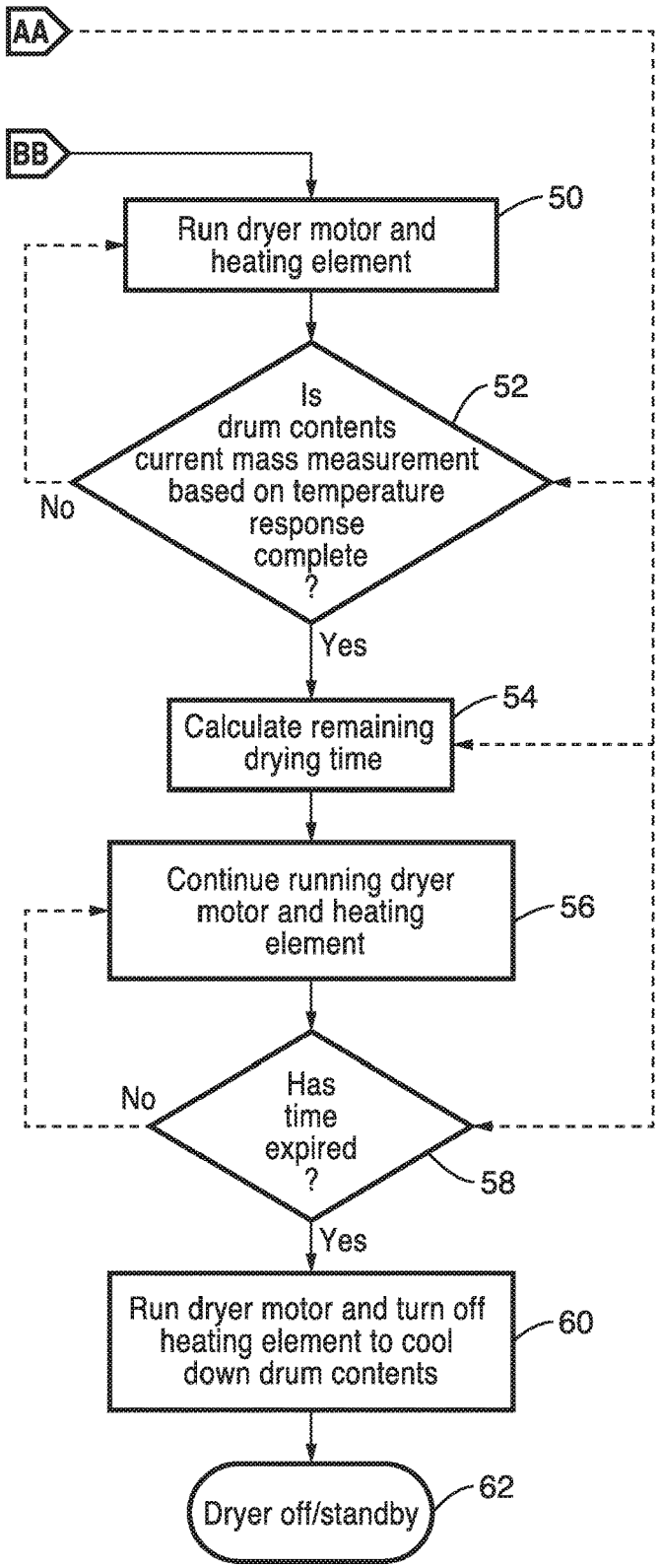

FIG. 2A and FIG. 2B together is a flow diagram of dryer control operations according to an embodiment of the present disclosure.

Figure 3:
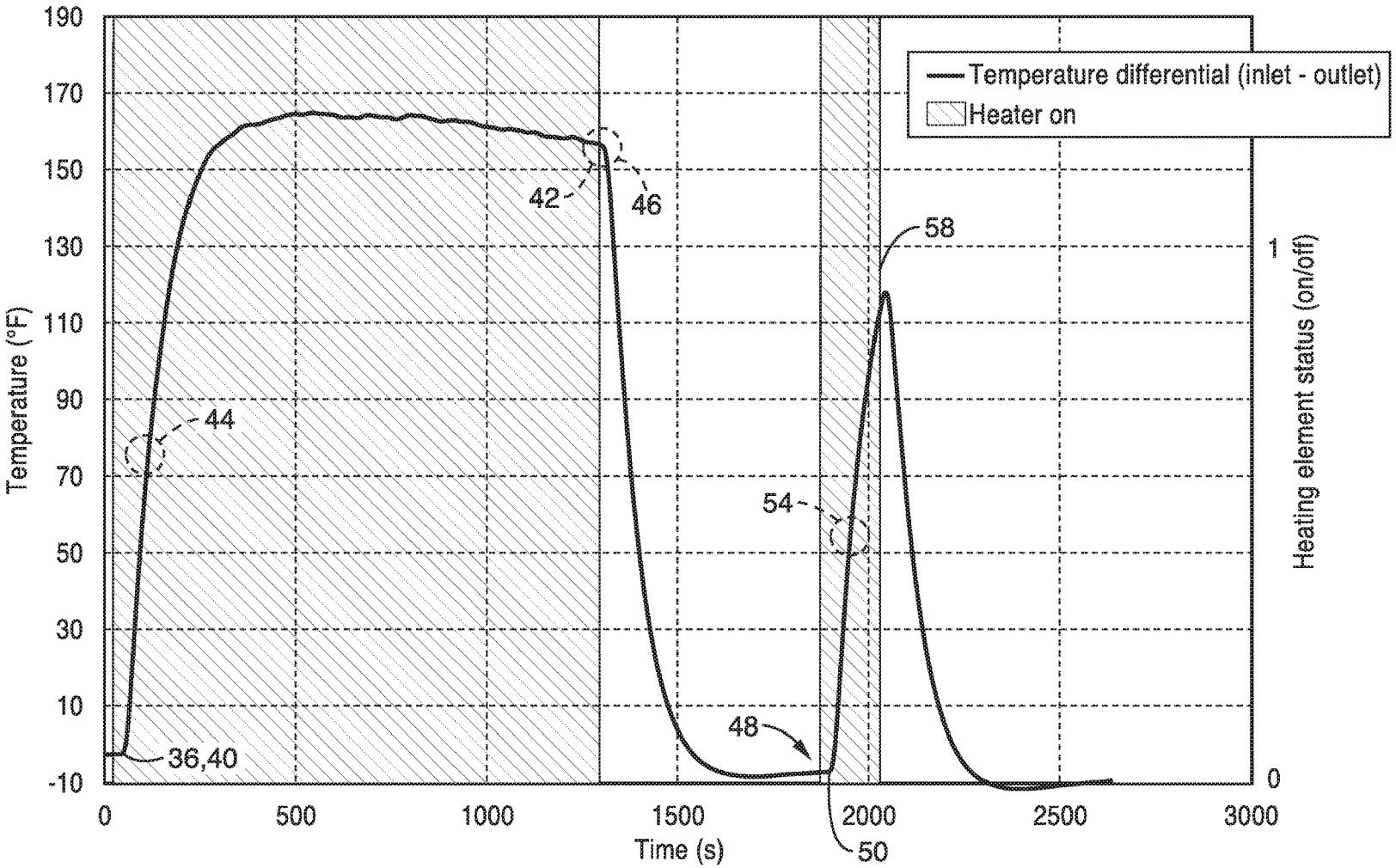

FIG. 3 is a plot of an example drying cycle utilizing a temperature controller according to an embodiment of the present disclosure.

DETAILED DESCRIPTION

1. Introduction.

The disclosed clothes dryer automatic end of cycle detection provides a relatively simple and inexpensive approach to improve the functioning of automatic clothes dryers. The following sections describe a general dryer block diagram (FIG. 1) relating to controlling the drying cycle, as well as a flow diagram (FIG. 2A and FIG. 2B) for the method control steps, and an example plot of a controller operating through a full drying cycle (FIG. 3). A number of alternative embodiments are described, and benefits enumerated for the given apparatus.

2. Embodiments of the Clothes Dryer Controller.

FIG. 1 illustrates an example embodiment 10 of an automatic clothes dryer having a controller which accurately determines dryer end-of-cycle and can optionally track dryer cycle efficiency, and perform self-calibration.

A dryer controller 11 is exemplified using a microcontroller 12 (e.g., CPU, microcontroller, microprocessor, processor-enabled ASIC or programmable system on a chip (PSOC), or other circuit configured for programmable control), and associated memory 14. It should be appreciated that multiple controllers and/or multiple memories may be utilized without departing from the teachings of the present disclosure, although this would generally increase cost. It should also be appreciated that dryer controller 11 may be alternatively implemented using programmable logic arrays, gate arrays, or other devices containing combinatorial logic and sequential logic, wherein the sequential logic is selected to perform the functions as described in the present disclosure. Still further the endpoint sensing comparisons between sensors can be performed utilizing analog circuitry by itself or in combination with sequential/logic circuitry, such as within an application-specific-integrated circuit (ASIC).

It should also be appreciated that modern clothes dryers are preferably implemented to include one or more computer processor devices (e.g., CPU, microprocessor, microcontroller, computer enabled ASIC, PSOC, etc.) and associated memory storing instructions (e.g., RAM, DRAM, NVRAM, FLASH, computer readable media, etc.) whereby programming (instructions) stored in the memory are executed on the processor to perform the steps of the various process methods described herein. These computer processors often handle communication at the user interface as well as actual control of motors and heaters involved in the drying cycle. The presented technology is non-limiting with regard to memory and computer-readable media, insofar as these are non-transitory, and thus not constituting a transitory electronic signal.

In FIG. 1, controller 11 is configured for communicating with a user interface 16, which comprises any desired combination of output indicators and user input sensing. By way of example and not limitation, the output indicators may comprise: graphic displays, textual displays, visual indicators, light emitting indicators, audio annunciators, and combinations thereof. The input sensing may similarly comprise any desired mechanism for receiving input from the user. By way of example and not limitation, the input sensing may comprise: touch screens, keypads, buttons, dials, audio input, wireless/wired remote connection, and combinations thereof. User interface 16 operates with controller 11 for allowing the user to control the dryer settings (e.g., type of cycle, drying parameters, input/output settings), and operation (e.g., Start/Stop/Pause), and for displaying information from the controller as to the selected settings and status of the dryer operations.

The figure depicts dryer 10 configured for receiving input from multiple clothes dryer sensors and for controlling multiple hardware elements within the dryer. The clothes dryer is configured for either vented or ventless (condenser) operation. In a vented dryer the air outlet from the dryer is coupled to an external vent, while in ventless dryers the outlet from the drum is coupled to a condenser (heat exchanger) system. By way of example and not limitation, the sensors are shown comprising at least one first sensor 22 (e.g., inlet temperature) and at least one second sensor 24 (e.g., drum outlet temperature, drum temperature, and/or drum contents temperature). The hardware elements being controlled by controller 11, include at least one drum motor 18, and at least one heater element 20. It should be appreciated that operation of motor 18 typically drives both drum rotation and fan (blower) output. However, the present invention is not limited to the above, as it can support dryers which utilize a separate blower device. The high current output devices are shown by way of example being controlled by CPU 12 through drivers, 17, 19, respectively, although one of ordinary skill in the art will appreciate that relays (i.e., solid state or otherwise) or other interfacing means may be utilized according to the present disclosure. It will also be appreciated that the dryer may be configured with any additional sensors and outputs, as desired, (e.g., door sensor, drum rate sensor, vibration sensor), without departing from the teachings of the present invention. Thus, it will be recognized that the controller according to the present embodiment may be incorporated within a wide range of automatic clothes dryers with minimal design change.

The disclosed automatic control measures temperature differences as an indicator for determining if the dryer has reached an end of its cycle. In a first embodiment, the input is measured as the temperature of the heated air entering the drum, while the output temperature can be measured as either: (a) the temperature of the air exiting the drum, (b) the temperature of the drum, or (c) the temperature of the contents inside the drum. The temperature differential between the two sensors (input to output) when properly analyzed according to the present disclosure provide sufficient information for determining the 'dryness' of the clothes, that is to say it indicates the state of water evaporation from the clothes. When the clothes are initially wet, the exhaust air temperature, drum temperature, or drum contents temperature will be significantly lower than the entering air. This is because both the initial temperature of the wet clothing is less than the heated air and because water evaporating from the clothing reduces the output temperature. The controller, however, need not perform any computations to provide this evaporative control, but only need to monitor the relative input and output conditions for detecting the extent to which the clothes have been dried.

The controller monitors the differences between these signals and ends this heating phase of the dryer cycle, such as when it is determined that the amount of water weight remaining in the drum is below a desired threshold when either the absolute differential drops below a set point or when the differential has a negative slope (within set tolerances). In at least one embodiment of the invention, this determination triggers an "almost dry" signal, followed by a cool down and load measurement cycle before completing drying of the clothing.

In at least one embodiment, the temperature differential signal is collected from when the dryer heat first turns on, with the changes in this signal being utilized to estimate the initial weight of the load of clothing by correlating the rate of the signal rise over a specified time period. This rate of temperature signal change is correlated to the mass of the contents in the dryer. The controller is configured to properly correlate signal change rate versus weight for a given dryer size and model, such as by programming the controller with calibration parameters for that dryer size and type, or by having the controller read a set of inputs that indicate model and/or size information which is used to lookup information about the dryer which is already contained in a non-volatile program/data store.

When the "almost dry" signal is determined, the load will be cooled, then the heat will be re-applied (re-fire), and this measurement will be repeated to determine the new mass of the contents. This information is thus used to determine the remaining drying time required.

In at least one embodiment, the determined initial weight, predicted dry weight, and drying time will also be utilized to track an energy efficiency metric for the dryer over time. In at least one embodiment the user will be alerted when the drying efficiency falls out of the expected range.

In at least one embodiment, the control system can be calibrated at the factory for the specific dryer. In addition, at least one embodiment provides for periodic (and/or on demand) self-calibration thereafter. The calibration is performed when the dryer is not otherwise in use, and the process re-calibrates the differential endpoint. During calibration, the controller operates the fan with and without the heater for a short time when the dryer is empty and measures the differential temperature response for the empty dryer. It will be appreciated that in the described system, the important measurement is the relative signal between the two sensors and not the actual temperature.

By way of example and not limitation, this input/output sensor calibration can be triggered in any of a number of ways without departing from the teachings of the present disclosure. For example the calibration may be performed on a time basis in response to factors such as time since last calibration. The calibration may be performed at any time when the dryer is empty. In certain embodiments, the user may select when to perform the calibration. Other calibration selection criterion may be utilized without departing from the teachings of the present disclosure.

Several types of sensors can be utilized to measure the properties of the incoming and exhaust air. Temperature sensors appear to be the least expensive and most robust option for sensor types to use at this time. It will be appreciated that different forms of temperature sensors may be utilized without limitation, including resistive temperature sensors, thermocouples, temperature sensor integrated circuits, and infrared temperature sensors. In one variation, thermocouples can be configured to directly measure the temperature differential by connecting the thermocouples in a thermopile configuration. In an alternative embodiment, relative humidity levels (input to exhaust) are monitored instead of temperatures, however, at this time relative humidity sensors are more expensive, less accurate, and less robust than the temperature sensors.

In at least one embodiment drum temperature is measured on the external side of the drum using either resistive type temperature sensors, thermocouples, or infrared sensors (pyrometers). Infrared sensors provide the advantage of not having to be in direct contact with the drum to measure the temperature.

In at least one embodiment, the temperature of the drum contents is measured inside the drum using resistive type temperature sensors, thermocouples, or the like, which come in direct contact with the drum contents. The temperature sensors can either be placed in multiple locations inside the drum or be enclosed in a device that tumbles with the clothes as the drum spins, such as providing a wireless communication to the dryer. It will be appreciated that multiple sensors of one or more types may be utilized as desired to permit averaging, or other data accumulation and processing to arrive at a more accurate overall temperature for the dryer contents.

FIG. 2A and FIG. 2B illustrate an example embodiment 30 of generalized steps for controlling clothes drying operations. In block 32 of FIG. 2A the dryer is in an off or standby mode, until it is determined in block 34 that a drying operation is to be commenced, at which time sensor data begins being recorded. It will be appreciated that this example embodiment utilizes differential temperature sensing as the metric for estimating the end of the dryer cycle, although other sensor types may be utilized as described in a previous section.

In block 36 the temperature data is recorded and stored, such as stored into block 38. Both the motor for the drum and fan (blower) and heating element of the dryer are activated 40. For the sake of simplicity of illustration, interlock mechanism(s) and other safety switching are not described herein. A determination is made for the "state of dryness" of the clothing at block 42. It is determined if the amount of water remaining on the clothing (e.g., water weight) is below a given threshold. In this example, the amount of water remaining is estimated based on the temperature differences which are made in reference to the stored temperature data 38. If this evaporative state has not yet attained a threshold level of "dryness" then execution returns again to block 40. Otherwise, the clothes have reached a target level of dryness for the remaining weight of water, wherein additional testing is performed to determine the percent of remaining moisture content based on the weight of the water remaining and the estimated weight of the dry load.

In block 44 an estimation is made of the initial mass of the drum contents. The estimation is determined for this embodiment based on the changes detected in the differential temperature (e.g., between incoming heated air and the outlet air).

By way of example and not limitation, upon reaching the "dryness" condition, the maximum rate of change, with respect to time, between the inlet and outlet temperatures (outlet air temperature, or drum temperature, or temperature of drum contents) are found in the measured data. In at least one embodiment, the maximum rate of change is used for calculating the weight of the load.

In step 46 the motor for the drum and fan (blower) continues running with the heating element turned off. A determination 48 is made if the dryer has cooled down to a desired differential temperature range. It should be appreciated that the dryer and its contents are cooled down so the system can re-measure the weight of the load by measuring a time response to it being heated again. If it has not sufficiently cooled-down, then execution returns to block 46, otherwise execution continues at block 50 in FIG. 2B with both the drum and fan (blower) motor and heater operating. A check is made at block 52 to determine if the temperature response profile for re-measurement of the load is complete. If the temperature response profile is not complete, then execution returns to block 50 with motor and heater still on. Otherwise, the response profile is complete and is utilized in block 54 to accurately determine the remaining drying time to reach the desired percent remaining moisture content. The drum motor and heater then continue in use 56 for the determined period, such as seen with periodic checks 58 for time expiration. Upon determining the end of the time period, then step 60 is entered, within which the heater is turned off while drum motor continues in operation to cool down the drum contents for a desired period of time and/or temperature level when the dryer is turned-off or put into standby mode 62.

The following is provided by way of example in measuring the current weight of the load. Basically, at block 42 the controller determines that there is a specific amount of water left; for instance less than 0.5 lbs. of water. If you have a small load, such as a dry weight of 2 lbs., then that 0.5 lbs. represents a significant amount of water in relation to the dry weight of the clothes contained in the dryer. Thus, the controller determines that the dryer is to run longer so that those clothes reach a desired level of "dry". A typical standard for "dry" clothes is approximately a 2% moisture level. So on a 2 lb. load of clothing that 2% moisture level equals 0.04 lbs. of water. Conversely, for a 12 lb. dry clothing load weight, up to about 0.24 lbs. of water remains at the end of the cycle at a 2% moisture level. It should also be recognized that when the controller of the dryer determines the weight of the load at the beginning; that this weight comprises some combination of water and clothing, but the proportions are unknown. At block 42, for example, the controller determines there is 0.5 lbs. of water left, so it re-measures the load size. Since it is known that there is 0.5 lbs. of water in that measurement and the remaining weight is clothing, the controller can readily determine the remaining amount of water to be removed.

FIG. 3 illustrates an example of a drying cycle using an embodiment of the disclosed differential temperature dryer cycle controller, showing a plot of temperature difference (e.g., between inlet air temperature and the temperature of outlet air, drum, or drum contents) over time in an upper curve and an on/off status of the dryer shown as hatched areas over the respective regions of the plot. In this plot references are made to associated step numbers depicted in FIG. 2A and FIG. 2B. At the far left, the dryer cycle commences (36, 40), and after a short period of time an estimation is made (44) of the initial drum contents based on rate of temperature differential change. Drying is seen continuing to a point (42) at which the amount of remaining liquid on the clothing is considered to have dropped to a selected threshold, at which time the heating element is switched off (46) to enter a cooling phase, until the temperature of the drum contents is below a threshold (48), at which time the heater elements and drum motor commence running again (50). As the drum contents heat up again, an estimation is performed to determine (54) remaining drying time, with drying continuing until a determination (58) that this time period has expired, upon which the heating element is switched off while the drum motor runs. Then after the clothing is sufficiently cooled, the dryer is turned off or put into standby mode.

3. Conclusions.

The controller described according to one or more embodiments of the present disclosure provide the following advantages over existing dryer control systems. (a) The differential signal sensing is not impacted by specific inlet air conditions. (b) Sensors can be configured so that actual contact is not necessary between dryer contents and the sensor(s). (c) Optional periodic self-calibration can be provided to maintain increased sensor accuracy over the lifetime of the dryer. (d) The sensor and controller can estimate average moisture content (dryness) of the contents of the dryer instead of relying on sensing only items that intermittently come into contact with the sensor. (e) The data used to determine when to terminate (shut-off) the drying cycle is stored which provides a basis upon which drying efficiency metrics can be assessed, so for example the user can be alerted when the efficiency of the dryer falls out of the expected range.

Embodiments of the present technology may be described herein with reference to flowchart illustrations of methods and systems according to embodiments of the technology, and/or procedures, algorithms, steps, operations, formulae, or other computational depictions, which may also be implemented as computer program products. In this regard, each block or step of a flowchart, and combinations of blocks (and/or steps) in a flowchart, as well as any procedure, algorithm, step, operation, formula, or computational depiction can be implemented by various means, such as hardware, firmware, and/or software including one or more computer program instructions embodied in computer-readable program code. As will be appreciated, any such computer program instructions may be executed by one or more computer processors, including without limitation a general purpose computer or special purpose computer, or other programmable processing apparatus to produce a machine, such that the computer program instructions which execute on the computer processor(s) or other programmable processing apparatus create means for implementing the function(s) specified.

Accordingly, blocks of the flowcharts, and procedures, algorithms, steps, operations, formulae, or computational depictions described herein support combinations of means for performing the specified function(s), combinations of steps for performing the specified function(s), and computer program instructions, such as embodied in computer-readable program code logic means, for performing the specified function(s). It will also be understood that each block of the flowchart illustrations, as well as any procedures, algorithms, steps, operations, formulae, or computational depictions and combinations thereof described herein, can be implemented by special purpose hardware-based computer systems which perform the specified function(s) or step(s), or combinations of special purpose hardware and computer-readable program code.

Furthermore, these computer program instructions, such as embodied in computer-readable program code, may also be stored in one or more computer-readable memory or memory devices that can direct a computer processor or other programmable processing apparatus to function in a particular manner, such that the instructions stored in the computer-readable memory or memory devices produce an article of manufacture including instruction means which implement the function specified in the block(s) of the flowchart(s). The computer program instructions may also be executed by a computer processor or other programmable processing apparatus to cause a series of operational steps to be performed on the computer processor or other programmable processing apparatus to produce a computer-implemented process such that the instructions which execute on the computer processor or other programmable processing apparatus provide steps for implementing the functions specified in the block(s) of the flowchart(s), procedure (s) algorithm(s), step(s), operation(s), formula(e), or computational depiction(s).

It will further be appreciated that the terms "programming" or "program executable" as used herein refer to one or more instructions that can be executed by one or more computer processors to perform one or more functions as described herein. The instructions can be embodied in software, in firmware, or in a combination of software and firmware. The instructions can be stored local to the device in non-transitory media, or can be stored remotely such as on a server, or all or a portion of the instructions can be stored locally and remotely. Instructions stored remotely can be downloaded (pushed) to the device by user initiation, or automatically based on one or more factors.

It will further be appreciated that as used herein, that the terms processor, computer processor, central processing unit (CPU), and computer are used synonymously to denote a device capable of executing the instructions and communicating with input/output interfaces and/or peripheral devices, and that the terms processor, computer processor, CPU, and computer are intended to encompass single or multiple devices, single core and multicore devices, and variations thereof.

From the description herein, it will be appreciated that that the present disclosure encompasses multiple embodiments which include, but are not limited to, the following:

1. An apparatus for controlling a drying cycle in a clothes dryer, comprising: (a) a clothes dryer having a drum, drum motor mechanically coupled for spinning the drum, at least one heating element for heating air received through an air inlet into the drum and an air output for air leaving the drum; (b) a first temperature sensor configured to sense temperature of air entering the drum through the air inlet; (c) at least a second temperature sensor configured to sense temperature of outlet air, the drum, and/or drum contents; (d) a hardware processor-based controller coupled to receive inputs from said first temperature sensor and at least said second temperature sensor, and instructions stored in non-transitory memory executable by the controller to control operation of the drum motor and heater element according to steps comprising: (d)(i) determining a temperature differential between said first temperature sensor and at least said second temperature sensor; and (d)(ii) operating the heating element based on estimating weight of drum contents at multiple periods based on changes in said temperature differential to control the length of the drying cycle.

2. The apparatus of any preceding embodiment, wherein said clothes dryer is a vented clothes dryer in which said air output is configured for coupling to an outside vent.

3. The apparatus of any preceding embodiment, wherein said clothes dryer is a non-vented clothes dryer in which said air output is configured for coupling to a heat exchanger.

4. The apparatus of any preceding embodiment, wherein said multiple periods comprises a first period of time in which a weight estimate of original drum contents is made based on changes in said temperature differential over a first period of time.

5. The apparatus of any preceding embodiment, wherein the clothes drying cycle continues to operate with both the heating element and drum motor operating after said first period of time, until it is determined in response to a second temperature differential result that the estimated remaining water weight in the drum has dropped below a first threshold level.

6. The apparatus of any preceding embodiment, further comprising running the dryer in a cool down period with drum motor running but with the heating element inactive for a period of time after said first threshold level is reached.

7. The apparatus of any preceding embodiment, further comprising determining a remaining drying time based on estimated drum content water weight and operating the heating element and drum motor for said remaining drying time.

8. The apparatus of any preceding embodiment, wherein said controller is further configured for performing a cooling cycle after operating the heating element and drum motor for said remaining drying time.

9. The apparatus of any preceding embodiment, wherein said cooling cycle is continued by said controller for a given period of time estimated to be sufficient for cooling the clothes down.

10. The apparatus of any preceding embodiment, wherein said cooling cycle is continued by said controller until the temperature differential across the drum has dropped to a desired temperature threshold.

11. The apparatus of any preceding embodiment, wherein said controller is configured for automatically calibrating at least said second temperature sensor with respect to the inlet air temperature sensor to achieve an accurate measurement of the temperature differential.

12. An apparatus for controlling a drying cycle in a clothes dryer, comprising: (a) a clothes dryer having a drum, drum motor mechanically coupled for spinning the drum, at least one heating element for heating air received through an air inlet into the drum and an air outlet for exhausting air from the drum to an outside vent or to a heat exchanger; (b) a first temperature sensor configured to sense temperature of air entering the drum through the air inlet; (c) at least a second temperature sensor configured to sense temperature of outlet air, the drum, and/or drum contents; (d) a hardware processor-based controller coupled to receive inputs from said first temperature sensor and at least said second temperature sensor, and instructions stored in non-transitory memory executable by the controller to control operation of the drum motor and heater element according to steps comprising: (d)(i) determining a temperature differential between said first temperature sensor and at least said second temperature sensor; (d)(ii) estimating weight of original drum contents based on changes in said temperature differential over a first period of time; (d)(iii) continuing the clothes drying cycle operating both the heating element and drum motor; (d)(iv) estimating that remaining water weight in the drum has dropped below a first threshold level; (d)(v) running the dryer in a cool down period with drum motor running but with the heating element inactive; (d)(vi) turning on the heating element; (d)(vii) determining a remaining drying time based on estimated drum content water weight; and (d)(viii) operating the heating element and drum motor for said remaining drying time.

13. The apparatus of any preceding embodiment, wherein said controller is further configured for performing a cooling cycle after operating the heating element and drum motor for said remaining drying time.

14. The apparatus of any preceding embodiment, wherein said cooling cycle is continued by said controller for a given period of time estimated to be sufficient for cooling the clothes down.

15. The apparatus of any preceding embodiment, wherein said cooling cycle is continued by said controller until the temperature differential across the drum has dropped to a desired temperature threshold.

16. The apparatus of any preceding embodiment, wherein said controller is configured for automatically calibrating at least said second temperature sensor with respect to the first temperature sensor to achieve an accurate measurement of the temperature differential.

17. An apparatus for controlling a drying cycle in a clothes dryer, comprising: (a) a clothes dryer having a drum, drum motor mechanically coupled for spinning the drum, at least one heating element for heating air received through an air inlet into the drum and an air outlet for exhausting air from the drum to an outside vent or to a heat exchanger; (b) a first temperature sensor configured to sense temperature of air entering the drum through the air inlet; (c) at least a second temperature sensor configured to sense temperature of outlet air, the drum, and/or drum contents; (d) a dryer controller circuit having a computer processor coupled for receiving inputs from said first temperature sensor and at least said second temperature sensor, and for controlling operation of the drum motor and heater element; and (e) a non-transitory computer-readable memory storing instructions executable by the computer processor; (f) wherein said instructions, when executed by the computer processor, perform steps comprising: (f)(i) determining a temperature differential between said first temperature sensor and at least said second temperature sensor; and (f)(ii) operating the heating element based on estimating weight of drum contents at multiple periods based on changes in said temperature differential to control the length of the drying cycle.

18. The apparatus of any preceding embodiment, wherein said multiple periods comprises a first period of time in which a weight estimate of original drum contents is made based on changes in said temperature differential over a first period of time.

19. The apparatus of any preceding embodiment, wherein said instructions executed by the computer processor are configured for automatically calibrating at least said second temperature sensor with respect to the said first temperature sensor to achieve an accurate measurement of the temperature differential.

20. The apparatus of any preceding embodiment, wherein said computer processor of said dryer controller circuit is selected from the group of processor equipped circuits consisting of CPUs, microcontrollers, microprocessors, processor-enabled application-specific-circuitry (ASIC), programmable system on a chip (PSOC), and other circuits configured for programmable control.

Although the description herein contains many details, these should not be construed as limiting the scope of the disclosure but as merely providing illustrations of some of the presently preferred embodiments. Therefore, it will be appreciated that the scope of the disclosure fully encompasses other embodiments which may become obvious to those skilled in the art.

In the claims, reference to an element in the singular is not intended to mean "one and only one" unless explicitly so stated, but rather "one or more." All structural and functional equivalents to the elements of the disclosed embodiments that are known to those of ordinary skill in the art are expressly incorporated herein by reference and are intended to be encompassed by the present claims. Furthermore, no element, component, or method step in the present disclosure is intended to be dedicated to the public regardless of whether the element, component, or method step is explicitly recited in the claims. No claim element herein is to be construed as a "means plus function" element unless the element is expressly recited using the phrase "means for". No claim element herein is to be construed as a "step plus function" element unless the element is expressly recited using the phrase "step for".

What is claimed is:

1. An apparatus for controlling a drying cycle in a clothes dryer, comprising:

(a) a clothes dryer having a drum, drum motor mechanically coupled for spinning the drum, at least one heating element for heating air received through an air inlet into the drum and an air output for air leaving the drum;

(b) a first temperature sensor configured to sense temperature of air entering the drum through the air inlet;

(c) at least a second temperature sensor configured to sense temperature of outlet air, the drum, and/or drum contents;

(d) a hardware processor-based controller coupled to receive inputs from said first temperature sensor and at least said second temperature sensor, and instructions stored in non-transitory memory executable by the controller to control operation of the drum motor and heater element according to steps comprising:

(d)(i) determining a temperature differential between said first temperature sensor and at least said second temperature sensor; and (d)(ii) operating the heating element based on estimating weight of drum contents at multiple periods based on changes in said temperature differential to control the length of the drying cycle.

2. The apparatus as recited in claim 1, wherein said clothes dryer is a vented clothes dryer in which said air output is configured for coupling to an outside vent.

3. The apparatus as recited in claim 1, wherein said clothes dryer is a non-vented clothes dryer in which said air output is configured for coupling to a heat exchanger.

4. The apparatus as recited in claim 1, wherein said multiple periods comprises a first period of time in which a weight estimate of original drum contents is made based on changes in said temperature differential over a first period of time.

5. The apparatus as recited in claim 4, wherein the clothes drying cycle continues to operate with both the heating element and drum motor operating after said first period of time, until it is determined in response to a second temperature differential result that the estimated remaining water weight in the drum has dropped below a first threshold level.

6. The apparatus as recited in claim 5, further comprising running the dryer in a cool down period with drum motor running but with the heating element inactive for a period of time after said first threshold level is reached.

7. The apparatus as recited in claim 6, further comprising determining a remaining drying time based on estimated drum content water weight and operating the heating element and drum motor for said remaining drying time.

8. The apparatus as recited in claim 1, wherein said controller is further configured for performing a cooling cycle after operating the heating element and drum motor for said remaining drying time.

9. The apparatus as recited in claim 8, wherein said cooling cycle is continued by said controller for a given period of time estimated to be sufficient for cooling the clothes down.

10. The apparatus as recited in claim 7, wherein said cooling cycle is continued by said controller until the temperature differential across the drum has dropped to a desired temperature threshold.

11. The apparatus as recited in claim 1, wherein said controller is configured for automatically calibrating at least said second temperature sensor with respect to the inlet air temperature sensor to achieve an accurate measurement of the temperature differential.

12. An apparatus for controlling a drying cycle in a clothes dryer, comprising:

(a) a clothes dryer having a drum, drum motor mechanically coupled for spinning the drum, at least one heating element for heating air received through an air inlet into the drum and an air outlet for exhausting air from the drum to an outside vent or to a heat exchanger;

(b) a first temperature sensor configured to sense temperature of air entering the drum through the air inlet;

(c) at least a second temperature sensor configured to sense temperature of outlet air, the drum, and/or drum contents;

(d) a hardware processor-based controller coupled to receive inputs from said first temperature sensor and said second temperature sensor, and instructions stored in non-transitory memory executable by the controller to control operation of the drum motor and heater element according to steps comprising:

(d)(i) determining a temperature differential between said first temperature sensor and at least said second temperature sensor;

(d)(ii) estimating weight of original drum contents based on changes in said temperature differential over a first period of time;

(d)(iii) continuing the clothes drying cycle operating both the heating element and drum motor;

(d)(iv) estimating that remaining water weight in the drum has dropped below a first threshold level;

(d)(v) running the dryer in a cool down period with drum motor running but with the heating element inactive;

(d)(vi) turning on the heating element;

(d)(vii) determining a remaining drying time based on estimated drum content water weight; and (d)(viii) operating the heating element and drum motor for said remaining drying time.

13. The apparatus as recited in claim 12, wherein said controller is further configured for performing a cooling cycle after operating the heating element and drum motor for said remaining drying time.

14. The apparatus as recited in claim 12, wherein said cooling cycle is continued by said controller for a given period of time estimated to be sufficient for cooling the clothes down.

15. The apparatus as recited in claim 12, wherein said cooling cycle is continued by said controller until the temperature differential across the drum has dropped to a desired temperature threshold.

16. The apparatus as recited in claim 12, wherein said controller is configured for automatically calibrating at least said second temperature sensor with respect to the first temperature sensor to achieve an accurate measurement of the temperature differential.

17. An apparatus for controlling a drying cycle in a clothes dryer, comprising:

(a) a clothes dryer having a drum, drum motor mechanically coupled for spinning the drum, at least one heating element for heating air received through an air inlet into the drum and an air outlet for exhausting air from the drum to an outside vent or to a heat exchanger;

(b) a first temperature sensor configured to sense temperature of air entering the drum through the air inlet;

(c) at least a second temperature sensor configured to sense temperature of outlet air, the drum, and/or drum contents;

(d) a dryer controller circuit having a computer processor coupled for receiving inputs from said first temperature sensor and at least said second temperature sensor, and for controlling operation of the drum motor and heater element; and (e) a non-transitory computer-readable memory storing instructions executable by the computer processor;

(f) wherein said instructions, when executed by the computer processor, perform steps comprising:

(f)(i) determining a temperature differential between said first temperature sensor and at least said second temperature sensor; and (f)(ii) operating the heating element based on estimating weight of drum contents at multiple periods based on changes in said temperature differential to control the length of the drying cycle.

18. The apparatus as recited in claim 17, wherein said multiple periods comprises a first period of time in which a weight estimate of original drum contents is made based on changes in said temperature differential over a first period of time.

19. The apparatus as recited in claim 17, wherein said instructions executed by the computer processor are configured for automatically calibrating at least said second temperature sensor with respect to the said first temperature sensor to achieve an accurate measurement of the temperature differential.

20. The apparatus as recited in claim 17, wherein said computer processor of said dryer controller circuit is selected from the group of processor equipped circuits consisting of CPUs, microcontrollers, microprocessors, processor-enabled application-specific-circuitry (ASIC), programmable system on a chip (PSOC), and other circuits configured for programmable control.

* * * * *